United States Patent [19]

Fields et al.

[11] Patent Number: 4,576,690

[45] Date of Patent: Mar. 18, 1986

[54] SEPARATION OF VOLATILE IMPURITIES FROM ALUMINUM CHLORIDE BEFORE ELECTROLYSIS

[75] Inventors: James R. Fields, Penn Township, Westmoreland County; Elmer H. Rogers, Jr; Larry K. King, both of Murrysville, all of Pa.

[73] Assignee: Aluminum Company of America, Pittsburgh, Pa.

[21] Appl. No.: 723,452

[22] Filed: Apr. 15, 1985

[51] Int. Cl.[4] ..... C25C 3/06; C25C 3/08

[52] U.S. Cl. ..... 204/67; 204/243 R; 204/246; 204/247

[58] Field of Search ..... 204/67, 245, 246, 247

[56] References Cited

U.S. PATENT DOCUMENTS

| | | | |
|---|---|---|---|
| 2,892,764 | 6/1959 | Andrews | 204/246 |
| 3,374,163 | 3/1968 | Meier et al. | 204/246 |
| 3,464,900 | 9/1969 | Foley et al. | 204/67 |
| 3,480,654 | 11/1969 | Sundermeyer et al. | 204/246 |
| 4,151,061 | 4/1979 | Ishikawa et al. | 204/247 |

*Primary Examiner*—Howard S. Williams

*Attorney, Agent, or Firm*—Glenn E. Klepac

[57] ABSTRACT

Separating volatile impurities from $AlCl_3$ by supplying impure $AlCl_3$ into a molten salt bath of a gas separation compartment in an electrolysis cell. The impurities are removed from the compartment and molten salt bath containing dissolved $AlCl_3$ is carried under a partition into a chamber where the $AlCl_3$ is electrolyzed. In a preferred embodiment, desublimation is avoided by supplying $AlCl_3$ to the bath as a gas rather than in solid form.

19 Claims, 2 Drawing Figures

SEPARATION OF VOLATILE IMPURITIES FROM ALUMINUM CHLORIDE BEFORE ELECTROLYSIS

FIELD OF THE INVENTION

The present invention relates to the production of aluminum by electrolysis of $AlCl_3$in a molten salt bath. More specifically, the invention comprises a method for separating volatile impurities from $AlCl_3$before it is electrolyzed.

BACKGROUND OF THE INVENTION

By a well-known process $AlCl_3$is electrolyzed to produce aluminum metal and chlorine gas. However, the $AlCl_3$is frequently contaminated with compounds such as $CO_2$, CO and $SO_2$ and smaller amounts of organic pollutants such as hexachlorobenzene. Such organic pollutants diminish the value of chlorine gas formed in the process unless they are separated either prior to electrolysis or afterwards. When the chlorine generated by electrolysis is recycled for chlorination of alumina, the concentration of organic pollutants tends to build up over time and may become hazardous.

Gaseous impurities have heretofore been removed from $AlCl_3$by various processes that include a step of desubliming the $AlCl_3$into solid form. Such processes are disclosed, for example, in Schoener et al U.S. Pat. No. 3,930,800 issued Jan. 6, 1976 and King et al U.S. Pat. No. 3,956,455 issued May 11, 1976. Although such desublimation processes remove most impurities, the desublimed $AlCl_3$ may still contain minor concentrations of organic pollutants such as hexachlorobenzene.

Foley et al U.S. Pat. No. 3,464,900 issued Sept. 2, 1969 discloses a process for production of aluminum from gaseous aluminum chloride wherein inert gases may be separated from the aluminum chloride. A fused salt electrolyte containing the chloride of a metal more electropositive than aluminum is electrolyzed to form a reductant that is dissolved in a molten cathode comprising an alloy of aluminum and the reductant. The molten alloy is then circulated to a reactor compartment wherein aluminum chloride is reacted with the reductant to form aluminum and a chloride of the reductant. Inert gas contaminants accompanying the aluminum chloride may be vented from the reactor compartment through a bleed tube.

In the process disclosed by Foley et al, gaseous aluminum chloride is reacted with a molten metal reductant rather than being dissolved in a molten salt bath. In addition, Foley et al do not electrolyze aluminum chloride but rather perform their electrolysis on a chloride of a metal that is more electropositive than aluminum, e.g. magnesium chloride. Magnesium formed by electrolysis of magnesium chloride is dissolved in aluminum and circulated as a molten aluminum-magnesium alloy to a reaction compartment wherein aluminum chloride is introduced.

It is a principal objective of the present invention to provide an economical method for removal of volatile impurities from $AlCl_3$. A related object of a preferred embodiment is to produce aluminum metal from gaseous $AlCl_3$ by electrolysis in a molten salt bath without an intermediate step wherein the gaseous $AlCl_3$ is desublimed to solid form.

Additional objects and advantages of the invention will become apparent to persons skilled in the art from the following specification and claims.

BRIEF SUMMARY OF THE INVENTION

In the present invention, aluminum is produced by electrolysis of $AlCl_3$ in a cell comprising an electrolysis chamber containing an electrode and a molten salt bath, a gas separation compartment containing molten salt bath, and a partition separating the chamber from the compartment. The compartment is supplied with $AlCl_3$ through an inlet tube having an orifice immersed in the compartment bath. Volatile impurities are removed from the compartment by an outlet spaced from the inlet tube orifice. The outlet is preferably located upwardly of the inlet tube orifice.

Broadly stated, the method of the invention comprises the following steps:

(a) supplying $AlCl_3$ through the inlet tube into the compartment bath, together with impurities that are insoluble in the bath, (b) evaporating said impurities from the bath and removing said impurities through the gas outlet, (c) dissolving $AlCl_3$ into the bath, (d) transferring bath containing dissolved $AlCl_3$ from the compartment into the chamber, and (e) electrolyzing $AlCl_3$ in the chamber to produce aluminum, $Cl_2$ and used bath having a lower concentration of $AlCl_3$ than the bath of step (d).

The partition separating the chamber and compartment preferably comprises a baffle having a lower edge portion spaced upwardly from the compartment floor. The lower edge portion and floor define an opening connecting the chamber and compartment.

The $AlCl_3$ supplied to step (a) may be formed by chlorinating coked alumina at an elevated temperature. The chlorinating agent for this reaction may be chlorine gas obtained by electrolysis of $AlCl_3$ in the chamber. A bipolar electrolysis cell is preferred.

The molten salt bath in the chamber and compartment generally comprises NaCl, LiCl and $AlCl_3$. A preferred concentration of $AlCl_3$ is about 0.5 to 15 wt %.

DESCRIPTION OF A PREFERRED EMBODIMENT

Figure 1:
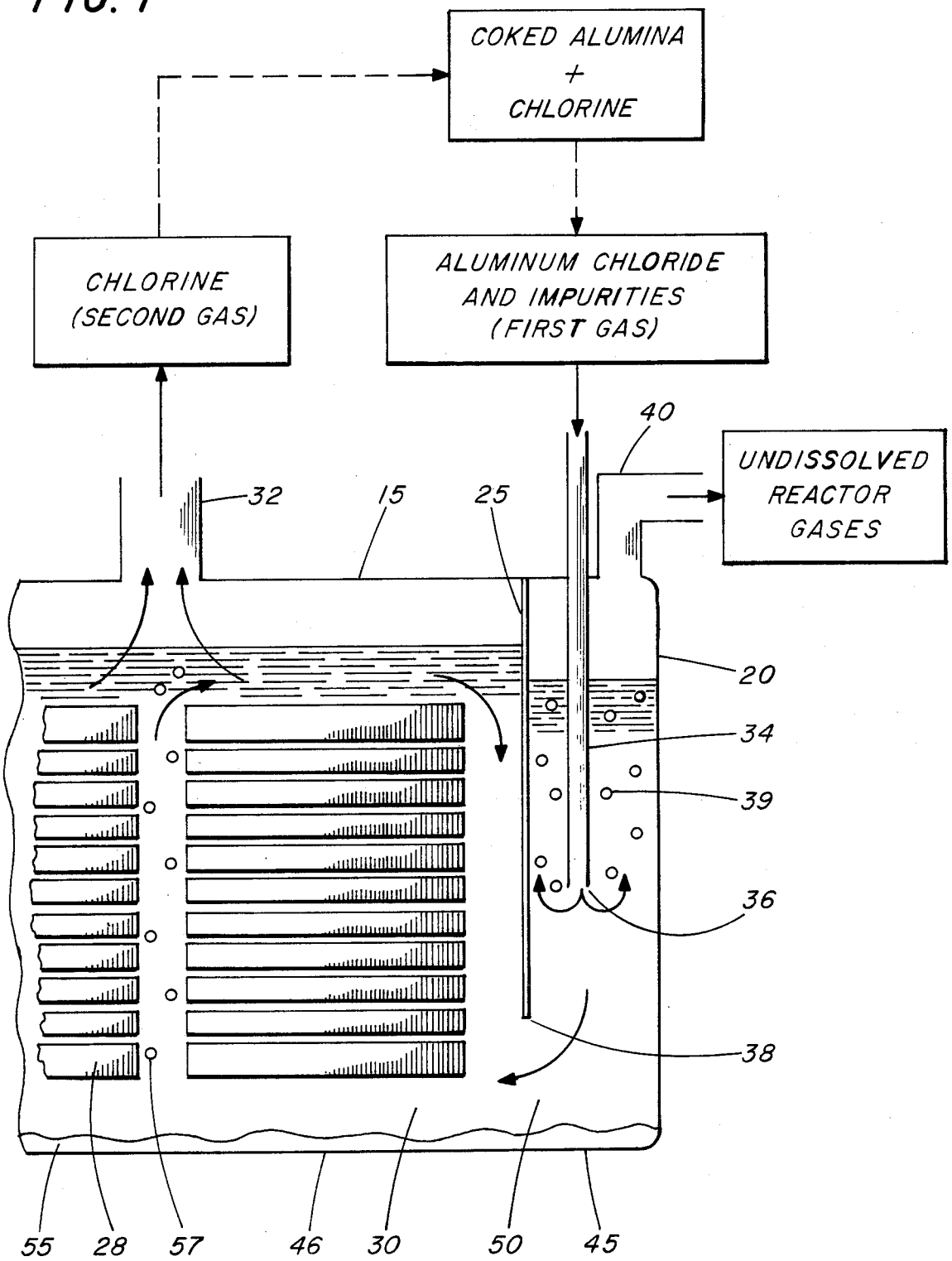
FIG. 1 is a schematic illustration of a preferred apparatus for performing the method of the invention.

The particularly preferred electrolysis cell 10 shown in FIG. 1 comprises an electrolysis chamber 15, a gas separation compartment 20 and a partition or baffle 25 separating the chamber 15 from the compartment 20. The chamber contains a set of bipolar electrodes 28 contacting a molten salt bath 30. A port 32 provides a means for venting chlorine from the chamber 15. The partition 25 is preferably made from an electrically non-conductive material that is resistant to attack by the bath 30. The electrodes 28 are made from carbon, preferably graphite. The bath 30 comprises aluminum chloride dissolved in other metal chlorides. A preferred composition includes about 50–75 wt % NaCl, about 25–50 wt % LiCl and about 0.5–15 wt % $AlCl_3$. Minor proportions of other metal chlorides such as KCl, $MgCl_2$ and $CaCl_2$ may also be included. The bath is employed in molten condition, usually at a temperature above the melting point of aluminum and in the range of 660°-730° C., typically about 700° C.

The following patents include additional description of the preferred bipolar electrolysis cell that is used in practice of the present invention: Dell et al U.S. Pat. No. 3,822,195: Rogers U.S. Pat. No. 4,133,727 and Rogers et al U.S. Pat. No. 4,140,594. The disclosures of each such patents are incorporated herein by reference to the extent not inconsistent with the present invention.

A gas inlet tube 34 conducts a first gas containing $AlCl_3$ and impurities through an orifice 36 into the bath 30 in the compartment 20. The orifice 36 is spaced upwardly of a lower edge portion 38 of the partition 25. Sufficient $AlCl_3$ is dissolved in the bath 30 to maintain $AlCl_3$ concentration at about 0.5-15 wt %. A preferred $AlCl_3$ concentration is about 5 wt %.

Gaseous impurities 39 in the first gas are relatively insoluble in the bath 30 compared with $AlCl_3$. These impurities 39 bubble upwardly through the bath 30 and then are removed through a gas outlet 40 spaced upwardly from the inlet orifice 36. Some impurities usually present in the first gas include $CO_2$, CO, $SO_2$, hexachlorobenzene and other chlorinated hydrocarbons.

The compartment 20 includes a floor 45 that is generally coplanar with the chamber floor 46. The floor 45 and lower edge portion 38 of the partition define an opening 50 communicating between the chamber 15 and compartment 20. Molten salt bath 30 containing dissolved $AlCl_3$ is swept downwardly and laterally outwardly through the opening 50 into the chamber 15.

In the chamber 15, $AlCl_3$ is electrolyzed to form molten aluminum metal 55 that settles to the floor 46 and a second gas 57 (predominantly chlorine). The chlorine is swept upwardly by circulation of the bath 30 and removed through a gas port 32.

Removal of $AlCl_3$ from the molten salt bath by electrolysis results in used bath containing a reduced concentration of $AlCl_3$ compared with bath transferred from the compartment 20. The used bath is recirculated to the compartment 20, either through the opening 50 or through an aperture (not shown) in the baffle 25.

The first gas is preferably produced by chlorinating alumina mixed with carbon at an elevated temperature of about 500°-750° C. The alumina should have an average alpha alumina content of less than about 5 wt % and a surface area of at least about 10 $m^2/g$ The alumina is optimally impregnated with carbon by thermally cracking liquid hydrocarbon in contact therewith to form coked alumina having an average carbon content of about 17 wt %. The chlorination reaction is carried out by reacting chlorine gas with the coked alumina in a fluidized bed at a temperature of about 635° C. and pressure of about 1-2 atmospheres absolute. The second gas 57 formed by electrolysis in the chamber 15 and vented through the port 32 comprises a convenient source of chlorine. Additional details of the chlorination reaction are set forth in Russell et al U.S. Pat. No. 3,842,163, the disclosure of which is incorporated herein by reference to the extent not inconsistent with our present invention.

Figure 2:
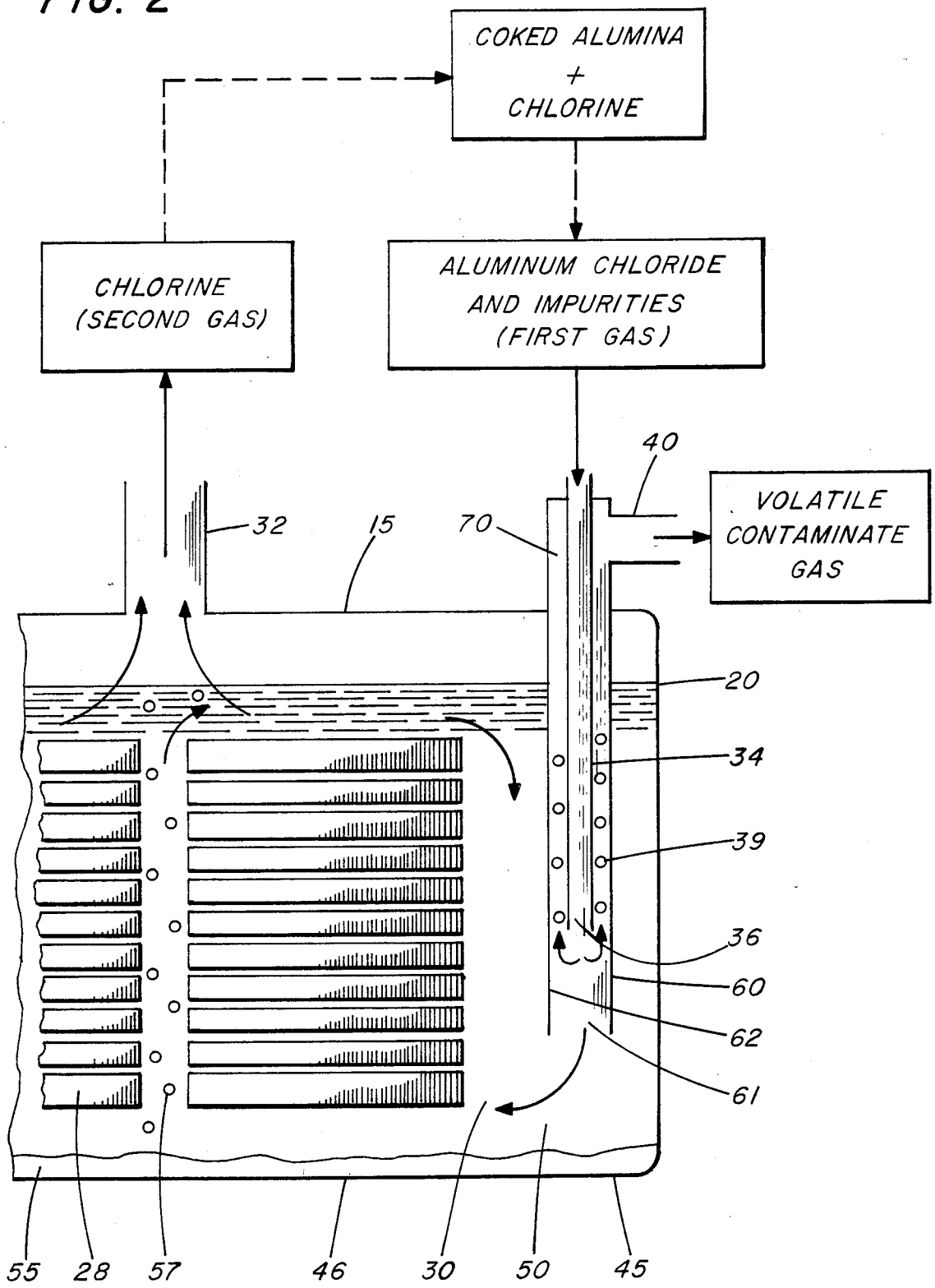
FIG. 2 is an alternative embodiment of the apparatus of FIG. 1.

Referring now to FIG. 2, in an alternative embodiment of the electrolysis cell 10 volatile impurities are separated from $AlCl_3$ by means of a gas seal tube assembly. The assembly comprises a generally cylindrical inlet tube 34 inserted within a generally cylindrical outer tube 60. A lower edge portion 61 of the outer tube 60 extends below an orifice 36 of the inlet tube 34. The inlet tube 34 and outer tube 60 are preferably constructed from quartz or other ceramic material that is resistant to attack by the salt bath 30.

A lateral wall portion 62 of the outer tube 60 adjacent the chamber 15 partitions first gas in the gas separation compartment 20 from the chamber 15. After the first gas emerges from the orifice 36, it bubbles upwardly through bath 30 to dissolve $AlCl_3$. Insoluble gaseous impurities 39 in the first gas reach a space 70 above the bath 30 between the inlet tube 34 and outer tube 60. The impurities are then removed through a gas outlet 40. Molten salt bath containing $AlCl_3$ is swept laterally below a lower edge portion 61 of the outer tube 60 into the chamber 15 where the $AlCl_3$ is electrolyzed at the electrodes 28.

While the invention has been described in terms of preferred embodiments, the claims appended hereto are intended to encompass all embodiments which fall within the spirit of the invention. For example, although the preferred method described above utilizes gaseous $AlCl_3$ as a reactant, persons skilled in the art will understand that $AlCl_3$ may also be fed to the molten salt bath in solid form.

What is claimed is:

1. A method for production of aluminum by electrolysis of $AlCl_3$ in a cell comprising an electrolysis chamber containing an electrode and a molten salt bath contacting said electrode, a gas separation compartment containing molten salt bath, a partition separating the chamber from the compartment, a gas inlet tube having an orifice in the compartment, a gas outlet for removing gas from the compartment, said outlet being spaced from said inlet tube orifice, said method comprising the steps of (a) supplying $AlCl_3$ containing impurities that are insoluble in the bath through the inlet tube into the bath, (b) evaporating said impurities from the bath and removing said impurities through the gas outlet, (c) dissolving $AlCl_3$ into the bath, (d) transferring bath containing dissolved $AlCl_3$ from the compartment into the chamber, and (e) electrolyzing $AlCl_3$ in the chamber to produce aluminum, $Cl_2$ and used bath having a lower concentration of $AlCl_3$ than the bath of step (d).

2. The method of claim 1 wherein said partition defines an opening connecting the chamber and the compartment.

3. The method of claim 1 wherein said compartment has a floor and said partition comprises a baffle having a lower edge portion spaced upwardly from the floor.

4. The method of claim 1 wherein the gas outlet is spaced upwardly of the inlet tube orifice.

5. The method of claim 1 further comprising (f) chlorinating coked alumina at an elevated temperature to produce a first gas containing $AlCl_3$ and volatile impurities, and (g) supplying said first gas to the bath in step (a).

6. The method of claim 5 wherein step (g) is performed without desubliming $AlCl_3$ from the first gas.

7. The method of claim 5 wherein said volatile impurities include hexachlorobenzene.

8. The method of claim 1 further comprising (f) returning used bath from the chamber to the compartment.

9. The method of claim 1 wherein step (e) is performed in a bipolar cell.

10. The method of claim 1 wherein said compartment is adjacent to said chamber.

11. The method of claim 1 wherein the molten salt bath in said chamber contains about 0.5 to 15 wt % $AlCl_3$.

12. The method of claim 1 further comprising (f) removing said $Cl_2$ from the chamber.

13. The method of claim 1 further comprising (f) desubliming gaseous $AlCl_3$ containing volatile impurities to obtain impure solid $AlCl_3$, and (g) supplying said impure solid $AlCl_3$ to step (a).

14. A method for production of aluminum by electrolysis of $AlCl_3$ in a cell comprising an electrolysis chamber containing an electrode and a molten salt bath contacting said electrode, a gas separation compartment containing molten salt bath, a partition separating the chamber from the compartment, a gas inlet tube having an orifice immersed in the compartment bath, a gas outlet for removing gas from the compartment, said outlet being spaced from said inlet tube orifice, said method comprising the steps of (a) supplying a first gas through the inlet tube into the compartment bath, said first gas containing gaseous $AlCl_3$ and gaseous impurities that are insoluble in the bath, (b) removing said gaseous impurities through the gas outlet, (c) dissolving $AlCl_3$ from the first gas into the bath, (d) transferring bath containing dissolved $AlCl_3$ from the compartment into the chamber, and (e) electrolyzing $AlCl_3$ in the chamber to produce aluminum, a second gas containing $Cl_2$ and used bath having a lower concentration of $AlCl_3$ than the bath of step (d).

15. In a method for production of aluminum by electrolysis of $AlCl_3$ in a cell, said method comprising the steps of:

(a) supplying a first gas through an orifice of an inlet tube into a molten salt bath in a gas separation compartment, said first gas containing gaseous $AlCl_3$ and volatile impurities that are insoluble in the bath, (b) dissolving $AlCl_3$ from the first gas into the bath, (c) transferring bath containing dissolved $AlCl_3$ from the compartment into an electrolysis chamber containing an electrode and molten salt bath, (d) electrolyzing $AlCl_3$ in the chamber to produce aluminum, a second gas containing $Cl_2$ and used bath having a lower concentration of $AlCl_3$ than the bath of step (c);

the improvement comprising (e) partitioning said compartment from said chamber in order to prevent passage of gases therebetween, (f) removing said volatile impurities through a gas outlet communicating with said compartment, and (g) returning used bath from the chamber to the compartment.

16. The method of claim 15 further comprising (g) chlorinating coked alumina at an elevated temperature to produce a first gas containing $AlCl_3$ and gaseous impurities, and (h) feeding said first gas to step (a).

17. The method of claim 15 further comprising (g) removing said second gas from the chamber.

18. The method of claim 15 wherein said compartment has a floor and said cell includes a baffle having a lower edge portion spaced upwardly from the floor, said lower edge portion and said floor defining an opening connecting the chamber and the compartment.

19. The method of claim 15 wherein the molten salt bath in said chamber contains about 0.5 to 15 wt % $AlCl_3$.

* * * * *